US007926860B2

(12) United States Patent
Hill et al.

(10) Patent No.: US 7,926,860 B2
(45) Date of Patent: Apr. 19, 2011

(54) ADJUSTABLE STRAP WITH HANDLES FOR LIFTING OBJECTS SAFELY

(75) Inventors: Brad Hill, Centerton, AR (US); David Hill, Bentonville, AR (US)

(73) Assignee: Landles, LLC, Centerton, AK (US)

( * ) Notice: Subject to any disclaimer, the term of this patent is extended or adjusted under 35 U.S.C. 154(b) by 762 days.

(21) Appl. No.: 11/895,336

(22) Filed: Aug. 24, 2007

(65) Prior Publication Data

US 2008/0303300 A1 Dec. 11, 2008

Related U.S. Application Data

(63) Continuation-in-part of application No. 29/244,157, filed on Dec. 6, 2005, now Pat. No. Des. 566,967.

(51) Int. Cl.
*A45F 5/00* (2006.01)

(52) U.S. Cl. ..... 294/152; 294/137; 294/167

(58) Field of Classification Search ..... 294/152, 294/137, 149, 150, 151, 153, 167; D3/327; 224/149, 150, 257, 258
See application file for complete search history.

(56) References Cited

U.S. PATENT DOCUMENTS

| | | | | |
|---|---|---|---|---|
| 279,706 | A | 6/1883 | Carroll | |
| 1,411,175 | A | 3/1922 | Maguire | |
| 3,143,266 | A * | 8/1964 | Midoriimatake | 294/152 |
| 3,841,542 | A | 10/1974 | Hogensen, Jr. | 224/5 |
| 4,431,226 | A | 2/1984 | Weilert | 294/150 |
| 4,696,505 | A | 9/1987 | Shadoan | 294/153 |
| 4,737,069 | A | 4/1988 | Coblentz | 414/786 |
| 4,832,393 | A | 5/1989 | Pitchford | 294/156 |
| 4,950,014 | A | 8/1990 | Smith | 294/152 |
| 5,169,199 | A | 12/1992 | De Ruyter et al. | 294/149 |
| 5,255,947 | A | 10/1993 | Schwartz | 294/31.2 |
| 5,368,353 | A | 11/1994 | Flanders et al. | 294/152 |
| 5,407,111 | A | 4/1995 | Lanouette et al. | 224/151 |
| 5,695,234 | A | 12/1997 | Coticchio et al. | 294/152 |
| 6,039,376 | A | 3/2000 | Lopreiato | 294/152 |
| 6,193,293 | B1 | 2/2001 | Ybanez | 294/152 |
| D457,725 | S * | 5/2002 | Parsons | D3/327 |
| 6,749,095 | B2 * | 6/2004 | Johnson | 224/250 |
| D500,598 | S | 1/2005 | Ramos | D3/327 |
| 6,908,131 | B2 | 6/2005 | Main et al. | 294/150 |
| D530,505 | S | 10/2006 | Mayfield | D3/228 |
| D532,201 | S | 11/2006 | Esch | D3/327 |
| D566,967 | S * | 4/2008 | Hill et al. | D3/327 |
| 2007/0120386 | A1 * | 5/2007 | Benysh et al. | 294/153 |

* cited by examiner

*Primary Examiner* — Paul T Chin
(74) *Attorney, Agent, or Firm* — Keisling & Piper, PLC; Stephen D. Schrantz

(57) ABSTRACT

A manual lifting apparatus for providing adjustable handles that allow a person to more effectively, efficiently, and safely lift objects. The present invention provides a webbing attached to two ergonomic handles that assists a user in lifting objects. The handles are adjustable to allow a user to adjust the height from which the user must lift the object thus allowing the user to effectively lift an object from the power zone to more effectively and safely lift objects.

20 Claims, 9 Drawing Sheets

ADJUSTABLE STRAP WITH HANDLES FOR LIFTING OBJECTS SAFELY

CROSS-REFERENCE TO RELATED APPLICATIONS

This application claims priority to and is a continuation-in-part of U.S. application Ser. No. 29/244,157, filed Dec. 6, 2005 now U.S. Pat. No. DES. 566,967.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention is related to a portable lifting device that allows a user to safely and effectively lift objects with a portable set of handles. Many tasks require workers to lift, push, pull and carry heavy loads. Heavy lifting can result in overexertion and injury to the lower back. The amount of weight a worker can safely lift depends on a number of factors. When the factors are such that the worker can assume an "ideal" body posture during the lift, the worker is able to lift greater loads in a safer manner. However, when the body posture is not ideal (e.g., back is bent or arms are outstretched), then the amount of weight the worker can safely lift is reduced.

Further, manual materials handling is the principal source of compensable injuries in the American work force, and four out of five of these injuries will affect the lower back. Back disorders are one of the leading causes of disability for people in their working years with a cost of about $50 billion annually in 1991 according to NIOSH. Further, one-fourth of all compensation indemnity claims involve back injuries, costing industry billions of dollars on top of the pain and suffering borne by employees. Preventing back injuries is a major workplace safety challenge. According to the Bureau of Labor Statistics ("BLS"), more than one million workers suffer back injuries each year, and back injuries account for one of every five workplace injuries or illnesses.

The United States Department of Labor has suggested a number of factors that help reduce the number of back injuries. The suggested factors attempt to redesign a job so that lifting becomes less hazardous. The suggested factors include the presence of handles, the stability of the package being handled, and the location of the object to be lifted in relation to the lifter. Other factors that have been suggested to prevent back injury include altering the task to eliminate the hazardous motion and/or changing the position of the object in relation to the employee's body. Lifting that occurs below knee height or above shoulder height is more strenuous than lifting between these limits.

In order to prevent possible back injury, a person lifting objects should reduce the moment. A moment acting about the spine is defined as a force (e.g., the weight of a lifted object) times the distance from the spine to the object's center. This distance has a multiplying effect on the force requirements of lifting a load. Thus, a 45 pound load being held 2 feet away from the body will result in twice the moment about the spine as a the same load held just 1 foot in front of the body. Recent scientific papers have shown that this load moment (the weight of an object multiplied by its distance to the spine) is one of the best predictors of the likelihood that someone will experience a low back injury. Thus, both reducing the weight of an object and reducing the horizontal distance to the load play a vital role in decreasing spinal stress. Some methods that reduce the distance to the center of the load include: eliminating physical barriers that prevent the worker from getting close to the load, pulling objects close to the body before lifting, and reducing the size of the object.

Further, specialists recommend that a person who lifts objects should reduce the amount that he must bend to lift the object. Recent studies have clearly shown multiple hazards related to bending the trunk forward when lifting. Bending forward creates an additional moment about the low back due to gravity, the weight of the torso, and the weight of the object to be lifted which the spine muscles must counteract through increased contraction. Spinal tissues have been found to fail much more quickly when this additional load is imposed. In addition, it has recently been found that when spinal muscles get stretched in sustained or repeated forward bending, the spinal muscles (through a feedback mechanism) actually lose strength and are more prone to spasm. The repeated forward bending posture also increases compression and shearing forces on vertebra and discs. Recovery from the effects of even a brief period of muscular overuse can take 24 hours or more. One of the most effective design changes that can be made is to simply grasp items using handles above the floor to manually lift items off the floor. Ideally, items should be stored about waist height, and should be stored no lower than knee height and no higher than shoulder height.

Further, lifting with wrists in a bent rather than straight position can result in ergonomic injuries, especially where the task also involves high hand force. Working with bent wrists puts stress on the tendons and tendon sheaths in the hands and wrists. When the wrists are bent, the tendons and sheaths rub against hard bones and ligaments. If this rubbing repeatedly occurs, the tendons and sheaths can become irritated and inflamed, resulting in injuries such as tendonitis. The inflamed tendons and sheaths can also press against the nerves that run through the wrist to the hand, resulting in carpal tunnel syndrome.

In general, the present invention relates to aids used by individuals to assist them in lifting and moving objects. Although many devices have been designed and are currently in use to lift objects from the ground or other surface on which they are lying, these known devices are bulky, heavy, and awkward to handle in-and-of themselves, and difficult if not impossible to utilize in confined spaces. Here, more particularly, the invention relates to a novel, lightweight, portable, adjustable, easy to operate lifting and carrying device made of a strong webbing or fabric-type material and ergonomic handles and the associated technique for aiding in lifting and carrying large heavy or awkward objects and masses.

The present invention provides medical personnel, common carriers of packages, shipping company docking crews, moving company drivers, marine biologists, construction/highway workers, carpet layers, homeowners, landscapers, and other individuals engaged in the lifting and/or moving of objects and masses, with a flexible, multi-use device with portable, reusable hand-holds/handles. As one will better appreciate after viewing the figures, unlike the available large, bulky transporters, the present invention has (1) a plurality of handles at each end of a flexible elongated webbing, such that the object contacts the upperside of the webbing while being lifted, moved, and positioned. Within the spirit and scope of the contemplated design goals, many different suitable flexible materials, temporary and permanent attachment mechanisms, suitable structure alternatives, etc., may be incorporated.

2. Description of the Known Art

U.S. Pat. No. 6,908,131 ("the '131 patent") issued to Main teaches a device having a flexible elongated support member having an upperside, an underside, and a first and second extension on either side of a central-portion, each of the first and second extensions have a free-end. The '131 patent further teaches a first and second strap portion affixed to and extending from the upperside between the free-ends of the support member. These strap portions are employed for positioning around the mass. The '131 patent further teaches a matable first and second coupling attached to a free end-section of each of the first and second strap portions. The strap portions may be adjustable in length with each respective coupling being slidably attached to its respective free end-section. Extending from the underside of the support member and along each of the first and second extensions, is a respective first and second plurality of handles affixed to at least the underside. Also, a method of lifting to carry a mass employing a device comprising a flexible elongated support member characterized herein. The method includes: placing the support member under the mass and positioning the first and second strap portion therearound; engaging a first and second coupling such that the mass fits snug within the strap portions; and grasping and applying a force to at least one handle from each of a first and second plurality of handles extending from, and affixed to, the underside along a respective one of the first and second extensions, to aid in the lifting. The '131 patent does not teach an adjustable webbing similar to the present invention. Instead, the '131 patent teaches tiered handles dispersed across the underside of support member. The '131 patent does not teach that the handles can be adjusted to a specific position. If a handle taught by the '131 patent is not in the proper position, a person must grasp an alternate handle which may not be located in the proper position. The present invention allows a user to reposition the handle to a precise position to allow a lift customized for every user and object.

U.S. Pat. No. 6,193,293 ("the '293 patent") issued to Ybanez teaches an apparatus adapted for securing and carrying box-shaped cargo, that allows the ready transportation of boxes through airports, train stations, bus terminals, and all other like applications. The apparatus taught by the '293 patent generally comprises a pair of retaining straps, a pair of horizontally disposed straps disposed to form adjustable loops, a pair of securing straps also disposed to form adjustable loops, and a pair of handles. The retaining straps surround and support the sides and bottom surfaces of the box. The horizontally disposed straps secure the front, rear, and side surfaces of the box. The securing straps secure the front, rear, bottom, and top surface of the box. A cross strap transverses the box between its side surfaces and is disposed perpendicularly to the securing straps. The '293 patent teaches multiple straps in a parallel orientation in relation to each other. Further, the '293 patent teaches that the multiple straps, at least one restraining strap and a horizontally disposed strap, are attached to each other in a perpendicular orientation. The perpendicular attachments and the additional straps increase the costs to produce the invention taught by the '293 patent and limits the number of items that the invention taught by the '293 patent can support.

U.S. Pat. No. 6,039,376 ("the '376 patent") issued to Lopreiato teaches a strap apparatus for carrying objects including a basic parallel and "X" configuration of a strap with strap elements extending outwardly from the base of the object being carried. In both the parallel and "X" configurations of use the strap apparatus are disposed at the bottom of an object to be carried and outwardly extending strap portions are disposed at the sides of the object. The outer ends of the straps comprise carrying handles. Two people secure the handles to carry the object. The '376 patent teaches that the overall length of the strap apparatus may be determined by choosing one forearm entry on each side of each strap to provide the users with a convenient length of the strap apparatus. The '376 patent does not reduce the length of the strap. Instead, a user grasps a lower handle thus creating excess slack caused by upper handles. This excess slack can obstruct a user's ability to lift the object. Further, the '376 patent requires at least two users to lift objects unlike the present invention that allows both single user and multiple users to lift an object.

U.S. Pat. No. 5,368,353 ("the '353 patent") issued to Flanders teaches a carrying device for lifting and transporting a balled and burlapped plant or the like without damaging the plant's root system or the top thereof. The carrying device includes at least two carrying straps having a fastening device at one end thereof. The straps taught by the '353 patent are arranged such that they adjoin or intersect at a point beneath the balled plant. A carrying handle extending between the carrying straps is positioned on each side of the intersection point near the top shoulder of the plant. Thus, the plant can be securely lifted by the carrying handles without causing a loosening of the earth ball or burlap surrounding the plant roots. The '353 patent does not teach a single webbing of a sufficient width to balance an object as utilized by the present invention. Further, the '353 patent does not teach an adjustable handle that allows a use to customize the lift.

U.S. Pat. No. 5,255,947 ("the '947 patent") issued to Schwarz teaches a device for lifting and inverting water bottles. The '947 patent teaches a pair of straps that have their ends secured to a handle. Each strap of the '947 patent passes through a tightening element and a pair of adjusting elements and around the bottle. An open slip knot is formed using the two straps. In operation the device taught by the '947 patent is oriented with each rope end on one side of the bottle having passed around the bottle and through an oppositely positioned adjusting element. The bottle may be carried upright. To invert, the adjusters are repositioned on the same side and the straps pass around the bottle at a position near the bottom. The bottle may be lifted and inverted using the device taught by the '947 patent as a pivot for such motion. The invention taught by the '947 patent is adapted to lift water bottles whereas the webbing of the present invention is adapted to receive and lift a variety of objects.

U.S. Pat. No. 4,950,014 ("the '014 patent") issued to Smith teaches a rectangular central flexible web or sling has its opposite ends rigidified by cross braces. Several handles extend outward at each end of the web. Each handle includes a double-thickness overfolded tab or web with spaced grommets for the ends of a cordlike handle loop. Loops at opposite ends of the sling are aligned. The invention taught by the '014 patent does not teach an adjustable webbing that allows a user to adjust the placement of the handles of the present invention.

U.S. Pat. No. 4,832,393 ("the '393 patent") issued to Pitchford teaches a device to lift objects with a single strap including a center panel attached directly to a handle, the panel sliding up and down between a pair of housing panels with alignable slot openings through the two panel members and the center panel, the combined opening being sufficient to receive a free end of the strap with the other end of the strap securely fastened to the opposite side of the device so that when the strap is wrapped around the object to be lifted, and the free end inserted through the combined openings lifting on the handle immediately grabs the strap and releasing of the handle immediately releases the strap. The '393 patent teaches a single handle located at the top of the object to be moved. The invention taught by the '393 patent requires a user to lift an object next to the body with one hand which places much more pressure on that side of the body and moves the object away from a user's body while transporting. Further, the present invention allows a user to lift an object between base of support and in front of body, not to one side with one hand. The '393 patent does not teach the use of at least two handles that assist the user in supporting the object with the user's body. Further, the '393 patent does not assist a user in lifting an object with both hands.

U.S. Pat. No. 4,737,069 ("the '069 patent") issued to Coblentz teaches a method of transporting bagged cargo. The method taught by the '069 patent comprises the steps of placing elongated bags on a strap with the transverse midline of each bag aligned on or over the strap. The strap is then fastened around the sides and over the top of the bags, therefore forming a matrix. The matrix is lifted by applying an upward and inward lifting force to the straps which contain the matrix, therefore unitizing the bags. In preferred embodiments, the height of the matrix is greater than or equal to 0.7 times the width of the matrix. In other embodiments of the invention taught by the '069 patent, an intermediate cross strap is provided to unitize the bottom half of the matrix separately from the top half. The resulting method permits a great number of bags to be efficiently transported to transshipment points with greatly reduced manpower and at reduced cost. The '069 patent does not teach the adjustable handle of the present invention.

U.S. Pat. No. 4,431,226 ("the '226 patent") issued to Weilert teaches a wrap-around band or strap mattress carriers to enable two people to carry large and cumbersome mattresses; variably adjustable wrap-around band and strap mattress carrying and handling devices which are adjustable and useable to fit and carry more than one size of mattress. The '226 patent teaches a lifting device designed to lift mattresses. The strap of the '226 patent is a length that fits around a mattress with handles that are not easily adjusted to lift smaller objects. Unlike the '226 patent, the present invention provides a webbing that is capable of lifting an increased number of objects.

Therefore, a new and useful lifting aid is needed to: prevent/minimize risk of injury to the individuals doing the lifting as well as risk of damaging an object to be lifted; make lifting heavy objects/masses less stressful; be less difficult to position under an object and later removed from under the object once moved and positioned at a destination. Unlike the transporters and lifting techniques currently available, the technique of the present invention employs a unique, safe and handy to operate device, as designed requiring less space to store and lighter (making it easier to carry into a rescue situation) than conventional transporters.

SUMMARY OF THE INVENTION

The present invention is a lifting device that adds the functional and comfortable use of handles to every object. The present invention uses mechanical advantage to allow safer lift to the object. The webbing of the present invention can be adjustable to adjust for the height of a user and to adjust the elevation from which a person must lift an object. The present invention is adapted to be used by either a single person or two people. The present invention provides at least one handle that allows a user to lift the object. The openings of the handles are large enough to comfortably fit a user's hand or hands if needed.

The present invention provides at least one handle made of durable ABS plastic. The handle is designed with three apertures (two for connecting the webbing and one for a user's hand or hands). The handle is hollow to decrease the weight of the handles. The interior of the handle utilizes inner ribs to provide a rigid structure that can withstand the weight of the object to be lifted.

The handle of the present invention utilizes a hand grip aperture or grip aperture that is ergonomically shaped to provide a comfortable grip to a plurality of users with different hand sizes. Further, the grip aperture of the present invention is large enough to allow a user to use both hands to grip the handle.

Further, the handle of the present invention utilizes upper web receiving aperture, lower web receiving aperture, and web retention crossbar to securedly attach the webbing to the handle. The present invention provides upper web receiving aperture and lower web receiving aperture to allow the webbing to be inserted through the handle. Crossbar is located between upper and lower web receiving aperture to contact the webbing and secure the webbing within the handle such that webbing and the handle are securedly attached.

The webbing of the present invention is a polypropylene nylon strap inserted through the handles of the present invention. The webbing is inserted through the handles and stitched to itself such that the webbing cannot be removed from the handles. In one embodiment of the present invention, the webbing adjusts to allow users to lift objects of numerous sizes. Further, the embodiment that utilizes adjustable webbing allows a user to position the handle in a location that can maximize his lifting efforts and avoid bending to lift the object. In another embodiment, the webbing is set at a fixed length that is not adjustable.

A retaining clip or slide of the present invention allows a user to adjust the webbing to increase or decrease the distance that the webbing would allow the handles to be separated. The retaining clip allows for the adjustment of the webbing and the positioning of the handles.

Briefly described, once again, the present invention includes a webbing securely attached to two handles. The webbing is employed for positioning under the object. The webbing may be adjustable in length. Each of the handles are preferably affixed at the end of the webbing, for stability when using the device.

It is a primary object of the present invention to provide an aid for lifting and carrying an object that includes flexible webbing with at least one handle, or hand-holds. It is a further object to provide a technique, utilizing a lifting device of the invention, to lift, and/or move and reposition objects in a safe manner.

It is an object of the present invention to maintain the load close to a user's body to allow the arms and elbows to be close to the torso during the lift to provide a user with greater control of the object during the lift. In addition, the present invention allows a user to increase the height at which a user can grasp the object to be lifted. By allowing a user to grasp an object at a location above the ground, the present invention causes the lift to occur in the power zone, an area close to the body, between mid-thigh and mid-chest height. The power zone is where arms, legs, and back can lift the most with the least amount of effort. The present invention allows a user to maintain neutral and straight spine alignment whenever possible.

Bending while lifting forces the back to support the weight of the upper body in addition to the weight lifted. Further, bending moves the load away from the body and allows leverage to significantly increase the effective load on the back. Such bending increases the stress on the lower spine and fatigues the muscles. It is an object of the present invention to allow a user to lift the object at a greater height than what would be possible without the present invention. Because of the increased height, a user does not have to bend as much thus decreasing the effort and strain that a user must exert to lift an object.

Further, the present invention provides proper handles that make lifting easier and reduce the risk of injury. The handholds of the present invention are large enough to accommodate larger hands and are ergonomically shaped such that the handholds do not dig into fingers and palms.

It is an object of the present invention to reduce the potential for injury. Further, the present invention helps avoid damaging an object undergoing movement and aids in making the lifting process less strenuous.

Further, it is an object of the present invention to reduce labor costs by increasing the objects that a user can safely lift.

It is a further object of the present invention to reduce production costs of a lifting device. The present invention is compact and lightweight, thus saving valuable storage space. Further, the reduced weight of the present invention reduces the total amount of weight that must be lifted and moved.

It is a further object of the present invention to add the comfort and functionality of handles to every object to be lifted.

It is a further object of the present invention to enable the user to adjust the height from which a user must lift an object by adjusting the length of the webbing.

It is a further object of the present invention to decrease forward trunk flexion to reduce interdiscal pressure and compression forces on the back.

It is a further object of the present invention to promote the suggestions of OSHA and the U.S. Dept. of Labor to create a safer lifting environment.

It is a further object of the present invention to reduce pressure on the flexor retinaculum (carpal tunnel area of the wrist) by keeping the wrist in a neutral position while lifting.

It is a further object of the present invention to promote the use of the larger leg muscles by limiting forward trunk flexion prompting the user to use the stronger leg muscles.

It is a further object of the present invention to reduce compression forces and interdiscal pressure on the back by limiting forward trunk flexion despite lifting with bad body mechanics.

It is a further object of the present invention to maintain the object close to a user's body during the lifting process.

It is a further object of the present invention to provide a user with greater control of the object during the lifting process.

It is a further object of the present invention to provide a flexible webbing that conforms to the object for maximum contact with the object to provide greater control of the object during the lifting process.

It is a further object of the present invention to add comfort and control to the lifting process to allow a user to lift objects for an increased period of time.

It is a further object of the present invention to provide webbing and handles with a long life span.

It is a further object of the present invention to promote lifting with a wide base of support.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
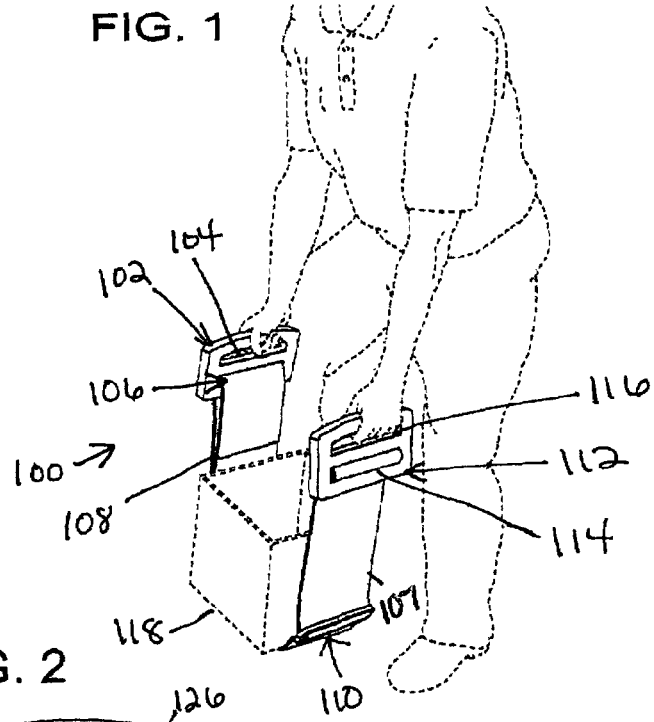
FIG. 1 is an environmental view showing one embodiment of the present invention.

FIG. 1 shows a user lifting object 118 with the device taught by the present invention generally shown by 100. As shown in FIG. 1, a user must position an object 108 to be lifted on the lifting surface of webbing 108. A user can tilt the object 108 and slide the lifting surface of webbing 108 underneath the object 118. After positioning the object 118 on the webbing 108, a user can adjust the retaining clip 110 to increase or decrease the amount of webbing 108 to position the handles 102, 112 into the most effective location to lift the object 108. As shown in FIG. 1, handles 102, 112 can be positioned in the power zone of the user by adjusting retaining clip 110 to increase the lifting surface of webbing 108.

A user grips the handles 102, 112 of the present invention through grip apertures 104, 116. The handles 102, 112 are constructed of a rigid material that allows a user to lift object 108 such that handles 102, 112 will not break or bend to prevent the handles 102, 112 from pinching or crushing a user's fingers.

The webbing 108 of the present invention is attached to handles 102, 112 at webbing retainers 106, 114. Webbing retainers 106, 114 are constructed of reinforced materials such that handles 102, 112 will retain webbing 108 while the present invention is in use.

Figure 2:
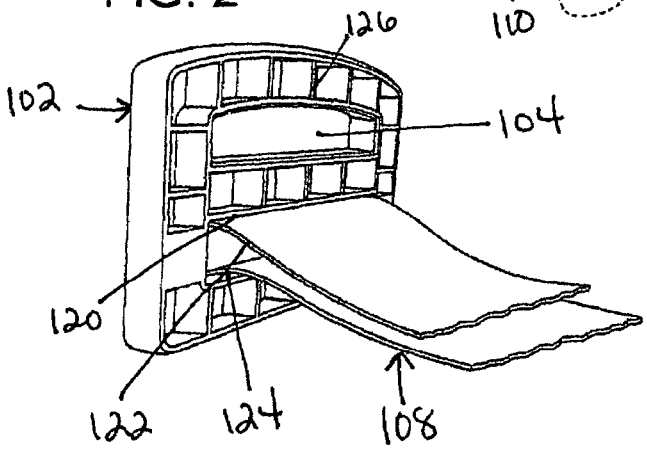
FIG. 2 is a perspective view of a portion of the invention.

FIG. 2 shows the attachment of webbing 108 through handle 102. Webbing 108 is inserted through upper web receiving aperture 120 and through lower web receiving aperture 124 such that webbing 108 is secured to handle at web retention crossbar 122. After webbing 108 is secured around crossbar 108, webbing is stitched onto itself such that webbing 108 is fixedly attached to handle 102.

Further, FIG. 2 shows an internal view of handle 102 in which the handle 102 is hollow. The present invention utilizes ribs 126 to reinforce the structure of handle 102. Ribs 126 allow handle 102 to be hollow to reduce the amount of materials needed to construct handle 102. Further, ribs 126 allow the removal of the extra weight caused by the additional materials used in the construction of handle 102. Ribs 126 are spaced throughout handle 102 to provide adequate support of handle 102 needed to maintain handle's 102 shape and strength while using the present invention to lift heavy objects.

As seen in FIG. 2, ribs 126 are not placed on either side of handle at web retention crossbar 122. The present invention is not hollow in the areas adjacent to the web retention crossbar 122 to add additional reinforcement and thus adequately support webbing 108 when the present invention is in use. The reinforced areas adjacent to web retention crossbar 122 prevent damage to web retention crossbar 122 and prevent webbing 108 from disengaging handle 102. Further, the webbing guide crossbar 156 found below lower retention aperture 130 and web retention crossbar 122 restricts movement of webbing 108 to further reinforce web retention crossbar 122. In other embodiments, the area adjacent to web retention crossbar 122 is hollow and supported by ribs, such as ribs 126, placed throughout handle 102.

Figure 3:
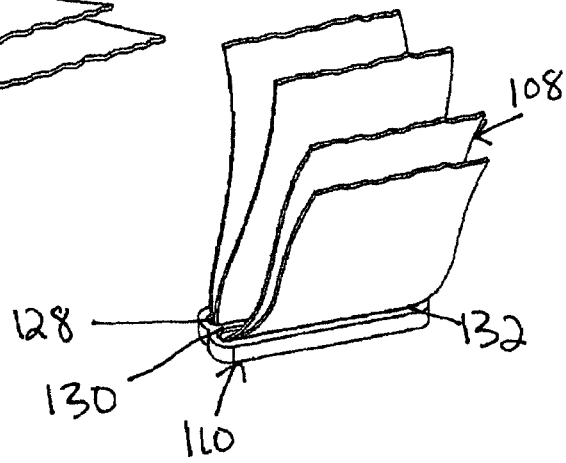
FIG. 3 is a perspective view of another portion of the invention.

FIG. 3 shows an enlarged view of retaining clip 110 that allows adjustment of webbing 108. As seen in FIG. 3, sections of webbing 108 are inserted through retaining clip 110 to allow for adjustment of webbing 108. As shown in FIG. 3, webbing 108 is inserted through retaining clip 110 through upper clip aperture 128 and lower clip aperture 132 such that clip crossbar 130 remains between the sections of webbing 108. The adjustment of the webbing 108 will be described in greater detail below.

Figure 4:
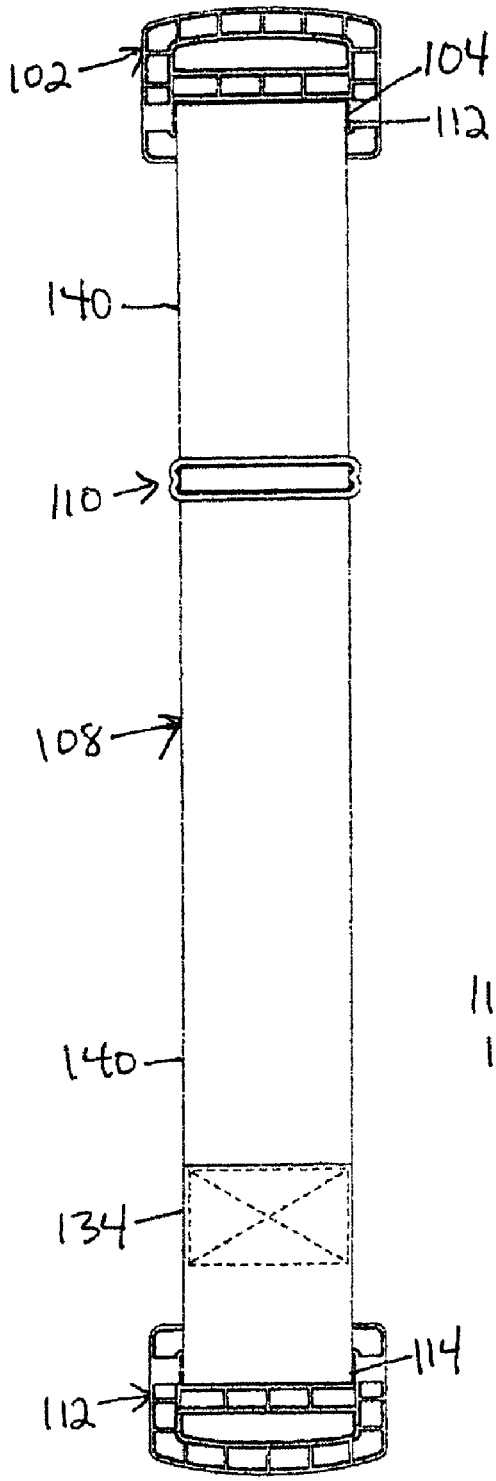
FIG. 4 is a front elevational view of the invention.

FIG. 4 shows a view of handles 102, 112 and the attachment of webbing 108 to handle 112. Webbing 108 is wrapped onto webbing retainers 104, 114. As shown in FIG. 2, webbing 108 is attached to web retention crossbar 122. After installing webbing 108 around web retention crossbar 122, webbing 108 is attached to itself using a box X sewing pattern. Webbing 108 can be attached around web retention crossbar 122 by other types of fasteners such as glue, staples, pins, and other known fasteners. Webbing 108 is inserted through upper web receiving aperture 120 and lower web receiving aperture 124 and around crossbar 122. Further, webbing 108 extends from the rear face of handles 102, 112.

Figure 5:
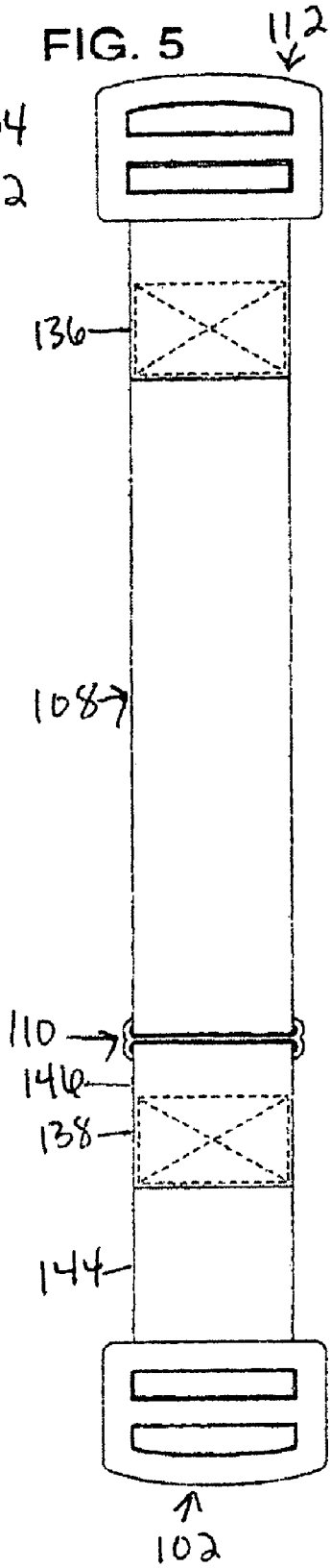
FIG. 5 is a rear elevational view thereof.

FIG. 5 shows the front side of handles 102, 112 and the attachment of webbing 108 to handles 102, 112. The ends of webbing 108 extend through handles 102, 112. The portion of webbing 108 is then fixedly attached to webbing 108 such that webbing 108 is fixedly attached to handles 102, 112. Webbing 108 is secured to itself at fasteners 136, 138 such that webbing 108 is fixedly attached to handles 102, 112. As seen if FIG. 5, webbing 108 is attached to handles 102, 112 such that webbing 108 extends from the back side of handles 102, 112 as shown in FIGS. 4-5.

Figure 6:
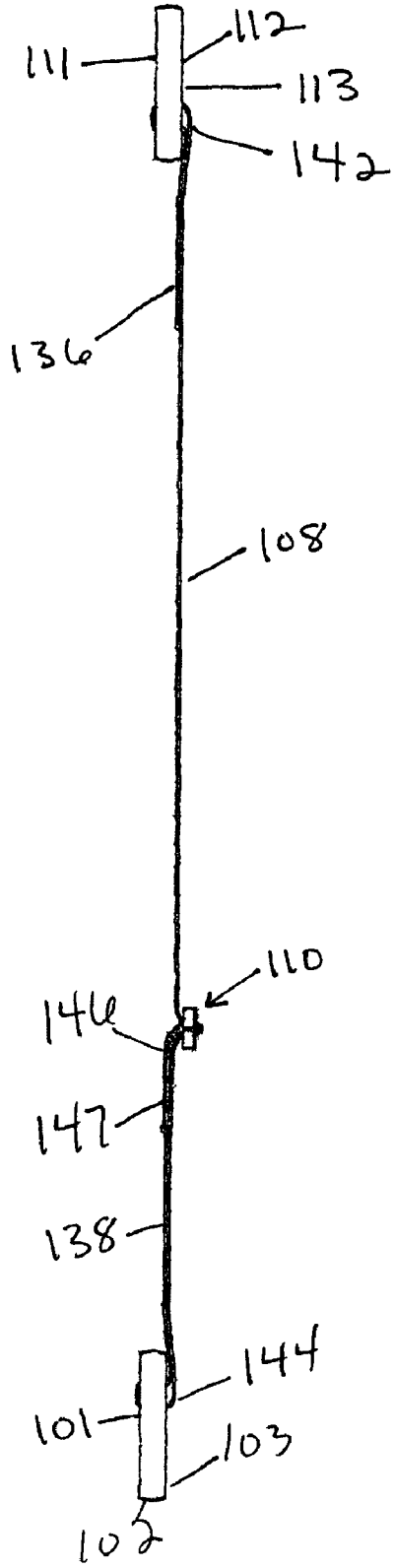
FIG. 6 is a side elevational view thereof, with the opposite side being a mirror image.

FIG. 6 shows a side view of the present invention in which webbing 108 extends from the front side 101 and back side 103 of handle 102. Regarding attachment of webbing 108 to handle 102, webbing 108 passes through handle 102 and exits handle 102 to form webbing loop 144. After exiting handle 102, webbing loop 144 is fixedly attached to webbing 108 at fastener 138.

One embodiment of the present invention utilizes an adjustable webbing loop 146 to allow a user to adjust the length of the lifting portion of the present invention. Webbing 108 passes through retaining clip 110 and exits retaining clip 110 to form adjustable webbing loop 146. After exiting retaining clip 110, webbing loop 146 is fixedly attached to webbing 108 such that retaining clip 110 is adjustably attached to webbing 108. The attachment of retaining clip 110 allows a user to adjust the length of webbing portion 140 in relation to adjustable webbing loop 146 such that the handles 102, 112 can be extended to the length of webbing portion 140.

Regarding the attachment of webbing 108 to handle 112, webbing 108 passes through into upper handle aperture 120 and exits handle lower aperture 124 as webbing loop 142. Webbing loop 142 is fixedly attached to webbing 108 at fastener 136 to attach webbing 108 to handle 112.

Figure 7:
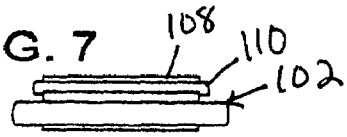
FIG. 7 is a top plan view thereof.
Figure 8:
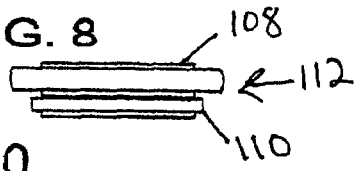
FIG. 8 is a bottom plan view thereof.

FIGS. 7-8 show the attachment of webbing 108 to handles 102, 112. Further, FIGS. 7-8 show the attachment of retaining clip 110 to webbing 108.

Figure 9:
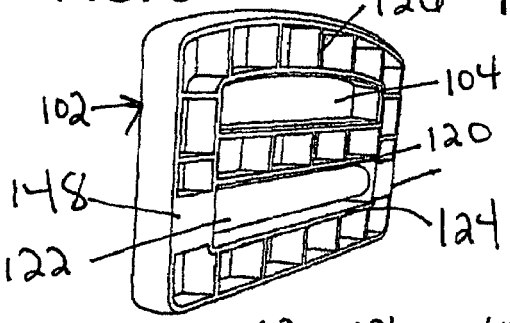
FIG. 9 is a perspective view of a portion of the invention taken generally from the front.
Figure 10:
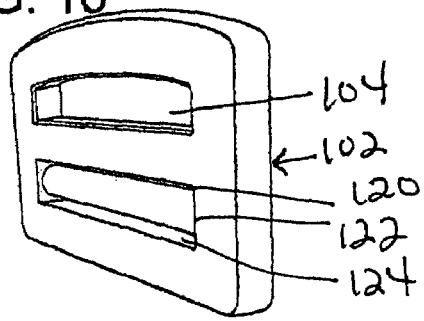
FIG. 10 is a perspective view of a portion of the invention taken generally from the rear.

FIGS. 9-10 show the cylindrical shape of web retention crossbar 122 for accepting webbing 108. Further, FIG. 9 shows that ribs 126 extend the width of handle 102 to provide additional strength to handle 102. Further, handle 102 is hollow to reduce the weight of handle 102. The addition of ribs 126 adds minimal weight to handle 102 while providing increased rigidity to handle 102 without the excess weight of additional materials. Further, FIG. 9 shows crossbar supports 148, 150 adjacent to web retention crossbar 122. Crossbar supports 148, 150 are not hollow like the other portions of handle 102. Instead, crossbar supports 148, 150 are solid supports that provide additional rigidity to handle 102 at the position of web retention crossbar 122.

Figure 11:
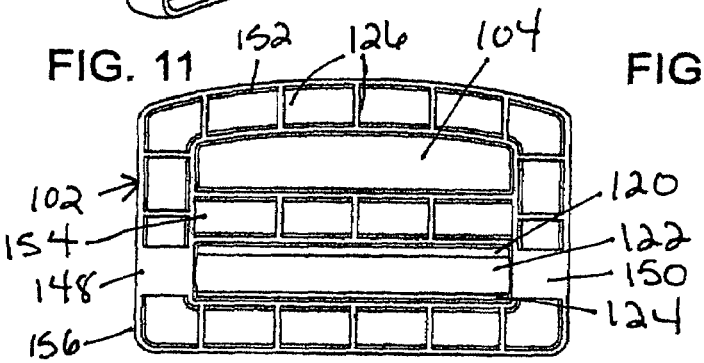
FIG. 11 is a front elevational view thereof.

FIG. 11 shows ribs 126 and the spacing of ribs 126 to increase the rigidity of handle 102. Additional ribs 126 can be dispersed throughout handle 102 to increase the rigidity of handle 102. Further, FIG. 11 shows crossbar supports 148, 150 that provide additional support at crossbar 122. As seen in FIG. 11, crossbar supports 148, 150 are adjacent to crossbar 122.

As shown in FIG. 11, the handle of the present invention utilizes a grip crossbar 152 and a hand grip aperture 104. The hand grip aperture 104 of one embodiment of the present invention is designed with a width of not less than about eight inches to allow a user to comfortably grip the handle with one or both hands. Further, the handle of one embodiment of the present invention utilizes web receiving apertures 120, 124 to retain webbing 108. In one embodiment, web receiving apertures 120, 124 are not less than about eight inches such that webbing 108, which is also not less than about eight inches, may pass through web receiving apertures 120, 124.

Further, one embodiment of the present invention utilizes a separating crossbar 154 that separates the webbing 108 of the present invention from a user's hands. The separating crossbar 154 adds an additional safety feature that reduces the possibility that a person's fingers can be lodged between the handle 102 and the webbing 108.

Further, one embodiment of the present invention utilizes a web guide crossbar 156 that is located below the web retention crossbar 122. The web guide crossbar 156 directs the webbing 108 to one side of the handle. As seen in FIG. 1, web guide crossbar directs webbing 108 between handle 112 and object 118.

Figure 12:
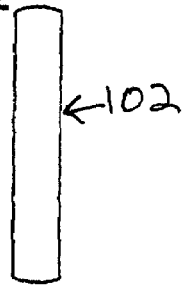
FIG. 12 is a side elevational view thereof, with the opposite side being a mirror image.
Figure 13:
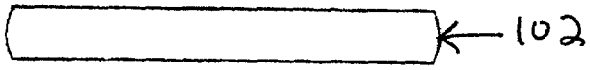
FIG. 13 is a top plan view thereof.
Figure 15:
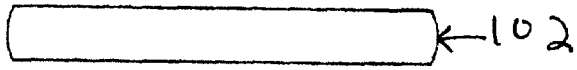
FIG. 15 is a bottom plan view thereof.
Figure 14:
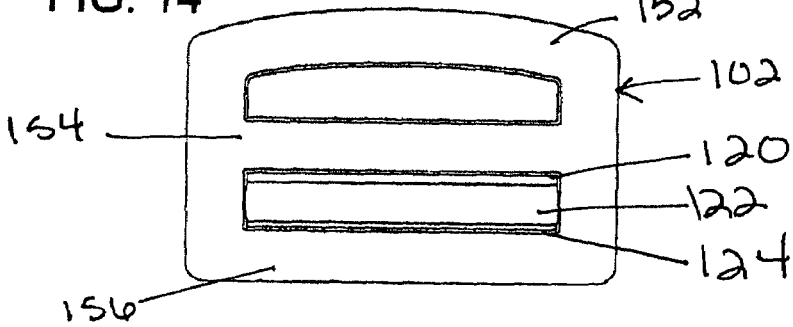
FIG. 14 is a rear elevational view thereof.
Figure 16:
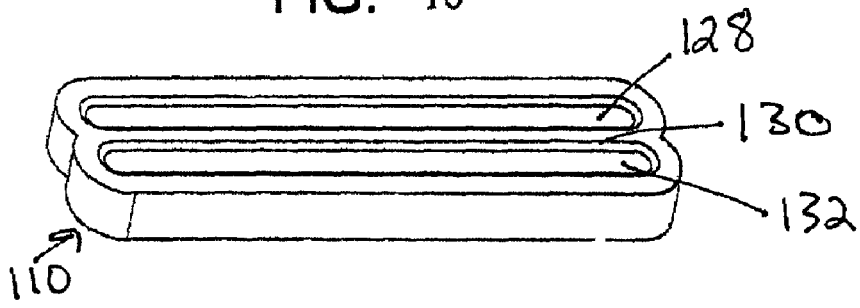
FIG. 16 is a perspective view of a portion of the invention taken generally from the front.
Figure 17:
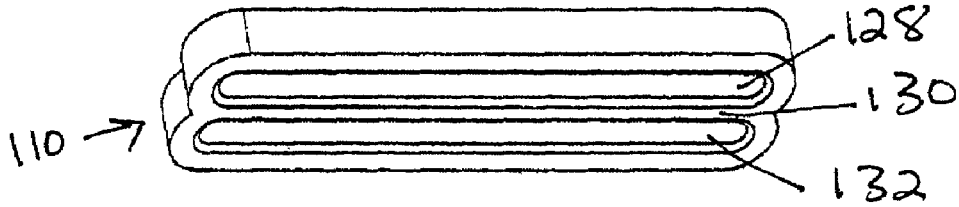
FIG. 17 is a perspective view of a portion of the invention taken generally from the rear.
Figure 18:
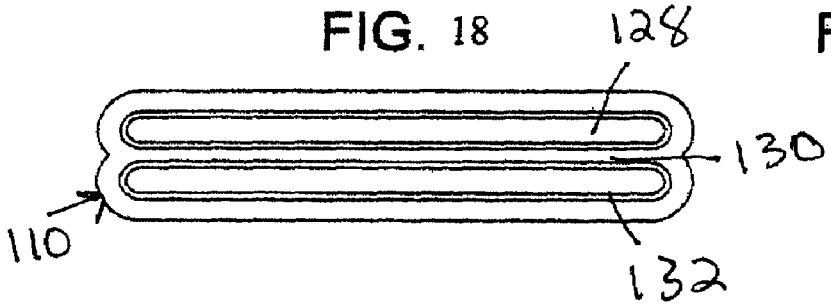
FIG. 18 is a front elevational view thereof with the opposite side being a mirror image.
Figure 19:
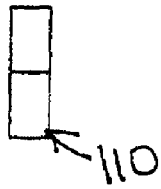
FIG. 19 is a side elevational view thereof, with the opposite side being a mirror image.
Figure 20:
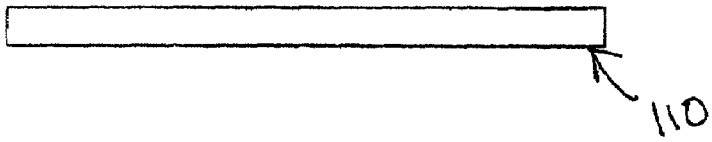
FIG. 20 is a top plan view thereof.

FIG. 12 shows a side elevational view of handle 102 showing that web retention crossbar 122 does not extend beyond handle 102. Further, FIGS. 13 and 15 show that web retention crossbar 122 does not extend beyond handle 102. FIG. 14 shows a rear elevational view of handle 102.

FIGS. 16-20 show retaining clip 110 and upper retention aperture 128 and lower retention aperture 130. As seen in FIGS. 16-20, retention apertures 128, 132 are wide enough to allow the webbing 108 to be inserted two times in both upper aperture 128 and lower aperture 132 as seen in FIG. 3.

Figure 21:
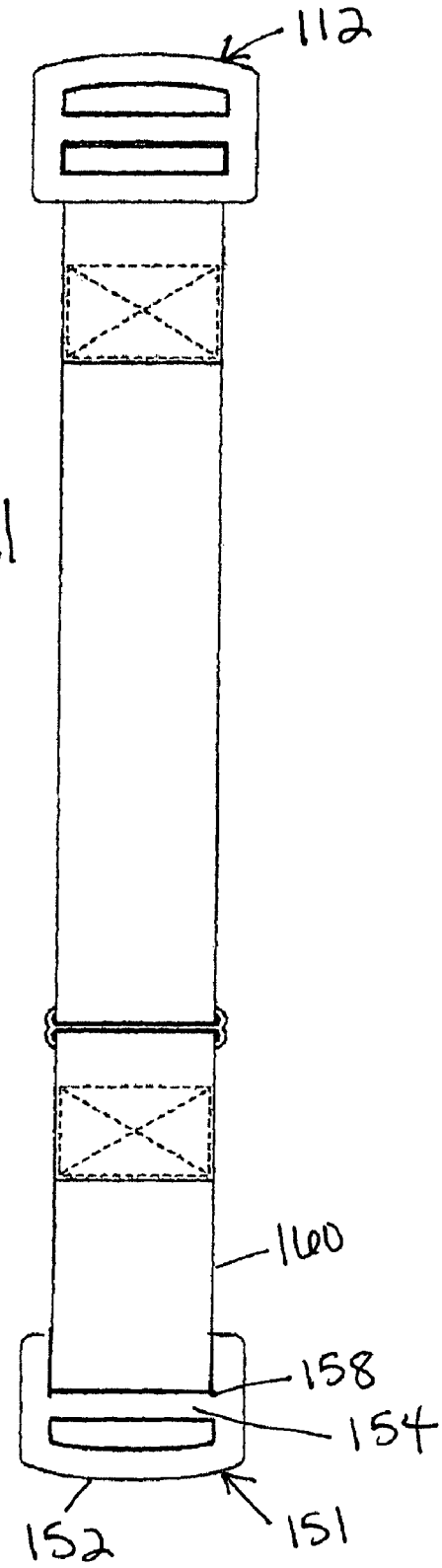
FIG. 21 is a rear elevational view of one embodiment of the present invention.
Figure 22:
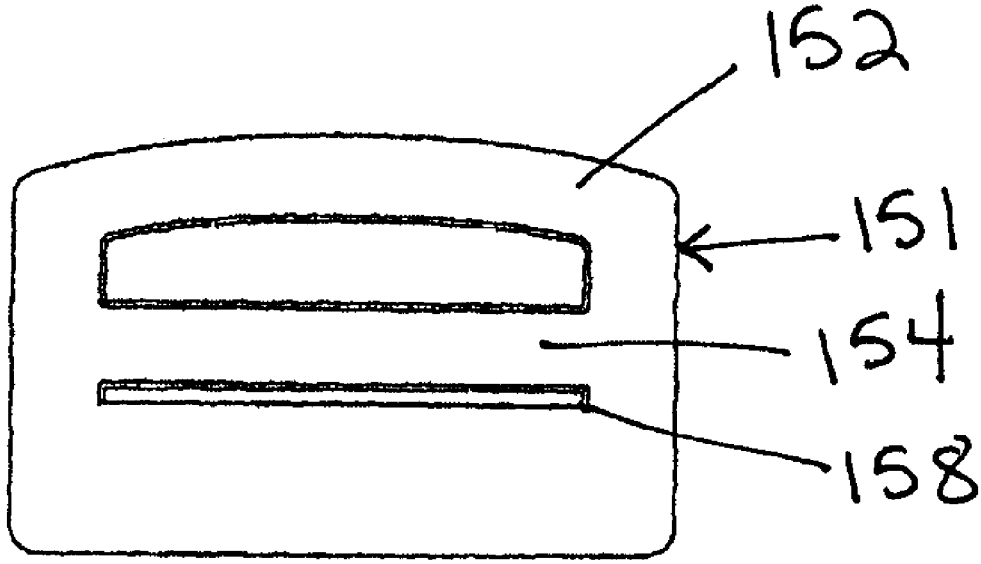
FIG. 22 is a rear elevational view of a portion of one embodiment of the present invention.

FIGS. 21-22 show one embodiment of the present invention that utilizes a single strap aperture. As seen in FIG. 21, two different types of handles can be employed in the present invention. Handle 151 utilizes a single strap retention aperture 158. Instead of passing through two apertures, web loop 160 only passes through a single strap retention aperture 158 to fixedly attach webbing 108 to handle 151.

Figure 23:
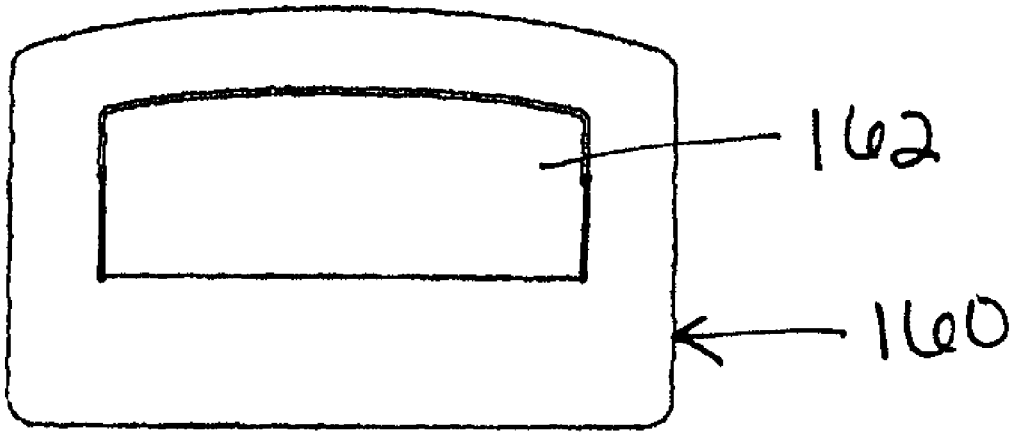
FIG. 23 is a rear elevational view of a portion of one embodiment of the present invention.

Further, FIG. 22 shows separating crossbar 154 that is used to separate a person's fingers from the webbing 108 when lifting an object. In another embodiment as shown in FIG. 23, the separating crossbar 154 is not required to separate a grip aperture from a web receiving aperture. The webbing 108 passes through web retaining aperture 162 of handle 160 such that webbing 108 can be attached to handle 162.

Figure 24:
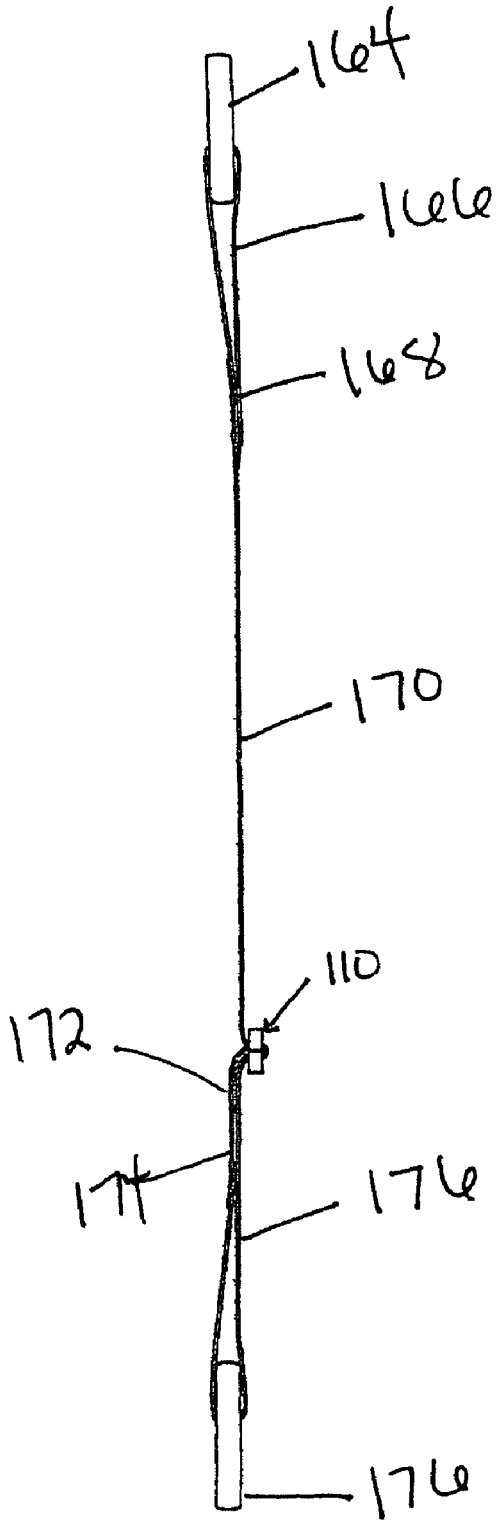
FIG. 24 is a side elevational view of one embodiment of the present invention, with the opposite side being a mirror image.

FIG. 24 shows one embodiment of the present invention utilizing webbing loops 166, 176 to attach webbing 170 to handles 164, 176. Further, webbing adjustable loop 172 attaches the retaining clip 110 to webbing 170 to allow adjustment of the length of webbing 170 such that a user can adjust the present invention to the desired length to properly lift an object. As shown in FIG. 24, webbing loops 166, 176, and 178 are attached to webbing 170 at fasteners 168, 174.

Figure 25:
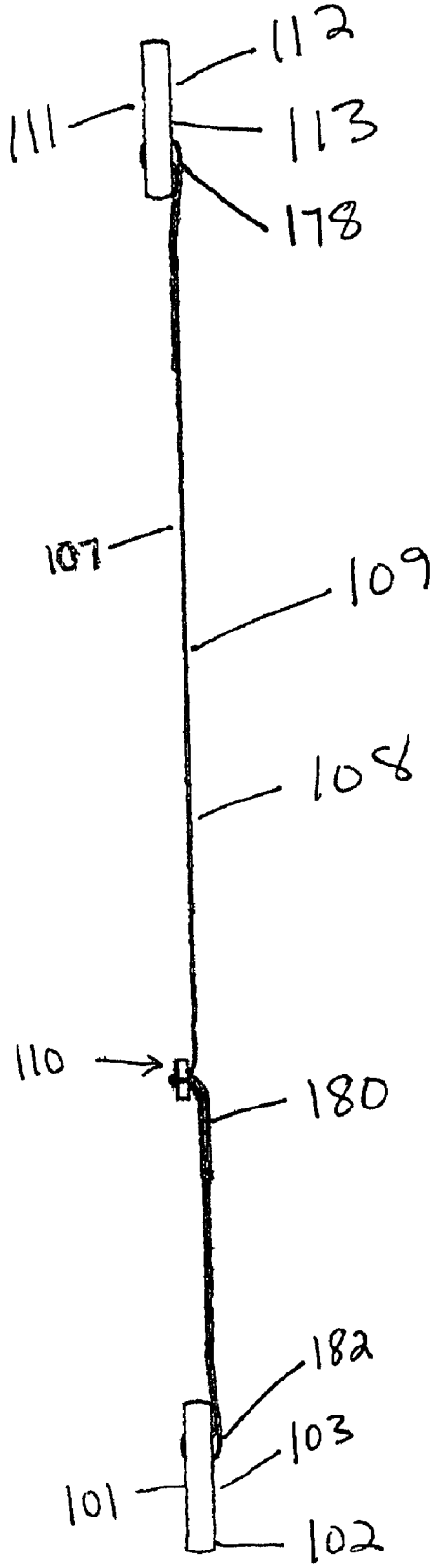
FIG. 25 is a side elevational view of one embodiment of the present invention, with the opposite side being a mirror image.

FIG. 25 shows another embodiment of the present invention utilizing webbing loops 178, 182 to attach webbing 108 to handles 112, 102. Handles 102, 112 force webbing 108 to side 103 of handle 102 and side 113 of handle 112 towards side 109 of webbing 108. Because an object to be lifted is located on side 109 of webbing 108, handles 102, 112 position webbing 108 towards both the object and the user. Handles 102, 112 position webbing 108 to the interior of the present invention such that webbing 108 is moved towards a user instead of away from the user and towards sides 101, 111 of handles 102, 112. Positioning webbing 108 towards the lifted object increases the contact of webbing 108 with the object and better stabilizes the object in relation to a user.

Further, adjustable webbing loop 180 attaches retaining clip 110 to side 107 of webbing 108 providing adjustable access to retaining clip 110 when an object is loaded on side 109 of webbing 108. The placement of retaining clip 110 on side 107 of webbing 108 allows simple adjustment of retaining clip 110 at all times including when an object is loaded on webbing 108. Such placement of retaining clip 110 also serves as a safety feature of the present invention. An object loaded on webbing 108 does not interfere with retaining clip 110. By preventing accidental repositioning of retaining clip 110, the present invention eliminates the possibility of increasing the length of webbing 108 while the present invention is in use. Therefore, the length of webbing 108 will not be accidentally adjusted to a greater length to cause a user to drop the object.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for lifting an object by a user, the apparatus comprising:

a webbing comprising a first loop and a second loop attachable to a first handle and a second handle, the webbing forming a lifting surface between the first handle and the second handle, the webbing adjustable to the user's preference to vary the length of the lifting surface between the first handle and the second handle to adjust placement of the first handle and the second handle for lifting the object wherein the length of the lifting surface remains approximately the same length while lifting the object;

a grip crossbar of the first handle adapted to be gripped by a person;

a web retention crossbar of the first handle, the webbing attaches to the web retention crossbar;

a grip crossbar of the second handle adapted to be gripped by a person;

a web retention crossbar of the second handle, the webbing attaches to the web retention crossbar.

2. The apparatus of claim 1 wherein:

at least one of the first or second handles is hollow with at least one rib internal of the handle wherein the at least one rib increases the rigidity of the handle.

3. The apparatus of claim 1 further comprising:

a web guide crossbar located below the web retention crossbar of the first or second handle guiding the webbing to one side of the handle.

4. The apparatus of claim 3 further comprising:

a separating crossbar located between the grip crossbar and the web retention crossbar to form a grip aperture and a web receiving aperture wherein the separating crossbar is adapted to separate the grip aperture from the web receiving aperture.

5. The apparatus of claim 1 wherein the web retention crossbar is a cylindrical shape to which the webbing attaches wherein the webbing is not less than about eight inches wide.

6. The apparatus of claim 1 further comprising:

at least one crossbar support within at least one of the handles adjacent to the web retention crossbar wherein the crossbar support is adapted to increase the rigidity of at least one of the handles at the web retention crossbar.

7. The apparatus of claim 1 further comprising:

a retaining body slidably attached between the ends of the webbing wherein the retaining body is configured for adjustment of the length of the lifting surface between the first handle and the second handle, the retaining body frictionally engaging the webbing to maintain the length of the lifting surface between the first handle and the second handle.

8. The apparatus of claim 7 further comprising:

at least one web receiving aperture of the retaining body wherein the web receiving aperture is adapted to allow the webbing to pass through the web receiving aperture of the retaining body at least two times to frictionally engage the webbing.

9. The apparatus of claim 7 further comprising:

a third loop attaching the retaining body to the webbing wherein the third loop is formed by passing the webbing through a first and second aperture of the retaining body and fixedly attaching the third loop to the webbing.

10. A manual lifting apparatus to assist a user in lifting at least one object, the apparatus comprising:

a first handle having a hand grip aperture and a web receiving aperture;

a second handle having a hand grip aperture and a web receiving aperture;

a webbing attached to the first handle and the second handle, the webbing forming a lifting surface between the first handle and the second handle, the webbing adjustable to vary the length of the lifting surface between the first handle and the second handle to adjust placement of the first handle and the second handle for lifting the object wherein the length of the lifting surface remains approximately the same length while lifting the object; and a retaining body contacting the webbing wherein the retaining body is configured for adjustment of the length of the lifting surface between the first handle and the second handle, the retaining body frictionally engaging the webbing to maintain the length of the lifting surface between the first handle and the second handle.

11. The apparatus of claim 10 wherein:

at least one of the first or second handles is hollow with at least one rib internal of the handle wherein the at least one rib increases the rigidity of the handle.

12. The apparatus of claim 10 further comprising:

a web guide crossbar located below the web receiving aperture of the first or second handle guiding the webbing to one side of the handle.

13. The apparatus of claim 10 further comprising:

a web retention crossbar across the width of at least one of said first handle or second handle wherein the webbing attaches to the web retention crossbar for attachment of the webbing to the first handle or the second handle;

wherein the webbing is not less than about eight inches wide.

14. The apparatus of claim 13 further comprising:

at least one crossbar support within the first handle adjacent to the web retention crossbar wherein the crossbar support is adapted to increase the rigidity of the first handle at the web retention crossbar.

15. The apparatus of claim 10 further comprising:

a separating crossbar located between the hand grip aperture and the web receiving aperture wherein the separating crossbar separates the hand grip aperture from the web receiving aperture.

16. The apparatus of claim 10 wherein:

the grip crossbar of the first handle or the second handle having a left end, a right end, and a middle portion wherein the middle portion is raised above the left end and the right end.

17. The apparatus of claim 10 further comprising:

at least one web receiving aperture of the retaining body wherein the web receiving aperture is adapted to allow the webbing to pass through the web receiving aperture of the retaining body at least two times to frictionally engage the webbing.

18. A manual lifting apparatus to assist a user in lifting at least one object, the apparatus comprising:

a first handle;

a grip crossbar of the first handle adapted to be gripped by a person;

a web retention crossbar of the first handle for securing a webbing to the first handle;

a second handle;

a grip crossbar of the second handle adapted to be gripped by a person;

a web retention crossbar of the second handle for securing the webbing to the second handle;

the webbing having a first end and a second end, the webbing forming a first loop proximate the first end and the webbing forming a second loop proximate the second end, the first loop attaching to the web retention crossbar of the first handle, the second loop attaching to the web retention crossbar of the second handle;

a web guide crossbar located below the web retention crossbar of the first or second handle guiding the webbing to one side of the handle;

a retaining body adjustably attached to the webbing between the first handle and the second handle wherein the retaining body is configured for adjustment of the length of the lifting surface between the first handle and the second handle, the retaining body frictionally engaging the webbing to maintain the length of the lifting surface between the first handle and the second handle.

19. The apparatus of claim 18 wherein:

at least one of the first or second handles is hollow with at least one rib internal of the handle wherein the at least one rib is adapted to increase the rigidity of the handle.

20. The apparatus of claim 18 wherein:

the grip crossbar of the first handle or the second handle having a left end, a right end, and a middle portion wherein the middle portion is raised above the left end and the right end.

* * * * *